US005938912A

United States Patent [19]

Jaeger

[11] Patent Number: 5,938,912

[45] Date of Patent: Aug. 17, 1999

[54] METHOD FOR PRODUCING GLASS ARTICLES WITH SELECTIVELY DEPOSITED OVERLAY

[76] Inventor: Peter C. Jaeger, 94 Ocean View Hwy., Watch Hill, R.I. 02891

[21] Appl. No.: 08/636,787

[22] Filed: Apr. 23, 1996

Related U.S. Application Data

[63] Continuation of application No. 08/106,134, Aug. 13, 1993, abandoned.

[51] Int. Cl.[6] ..... C25D 5/02

[52] U.S. Cl. ..... 205/120; 205/135; 205/162; 205/163

[58] Field of Search ..... 205/120, 135, 205/162, 163, 118, 122

[56] References Cited

U.S. PATENT DOCUMENTS

| | | | |
|---|---|---|---|
| 774,976 | 11/1904 | Blower | 205/120 |
| 2,335,376 | 11/1943 | Ballantine et al. | 205/162 X |
| 2,642,390 | 6/1953 | Garofano | 205/120 |
| 3,703,445 | 11/1972 | Tarnopol et al. | 205/120 |
| 3,964,914 | 6/1976 | Bullock et al. | 106/19 |
| 4,199,415 | 4/1980 | Sterling et al. | 204/15 |
| 4,409,261 | 10/1983 | Kuo | 427/96 |
| 5,006,207 | 4/1991 | Peterman et al. | 205/120 |

OTHER PUBLICATIONS

Robert C. Weast, editor, Handbook of Chemistry and Physics, 57th edition, CRC press, Cleveland, 1977, p. F.158.

*Primary Examiner*—Kathryn Gorgos
*Assistant Examiner*—William T. Leader
*Attorney, Agent, or Firm*—Duft, Graziano & Forest, PC; Curtis A. Vock, Esq.

[57] ABSTRACT

A method of providing a decorative metal pattern on an electrically non-conductive substrate, such as a glass or plastic substrate, which includes applying a mixture of a heat fusible material, such as glass or plastic, with a metal having a particle size less than about 500 mesh constituting at least 50% of the mixture, to the substrate in the desired pattern, heating the so-applied mixture until the heat fusible material fuses and bonds to the substrate, cleaning the substrate with the pattern thereon, and electroplating the pattern with the desired finish metal. In one method in which the mixture includes glass, a negative resist is adhesively secured to the substrate and the mixture is applied. The resist disintegrates upon heating. In another method, used when the substrate is plastic, a mixture of plastic and metal in paste form is applied to the substrate by silk screening or pad printing to form the pattern. In both cases, the pattern is bonded to the substrate by intermolecular bonding and has sufficient conductivity for electroplating without intermediate processing. Also, articles produced by such methods.

28 Claims, 1 Drawing Sheet

FIG. 1
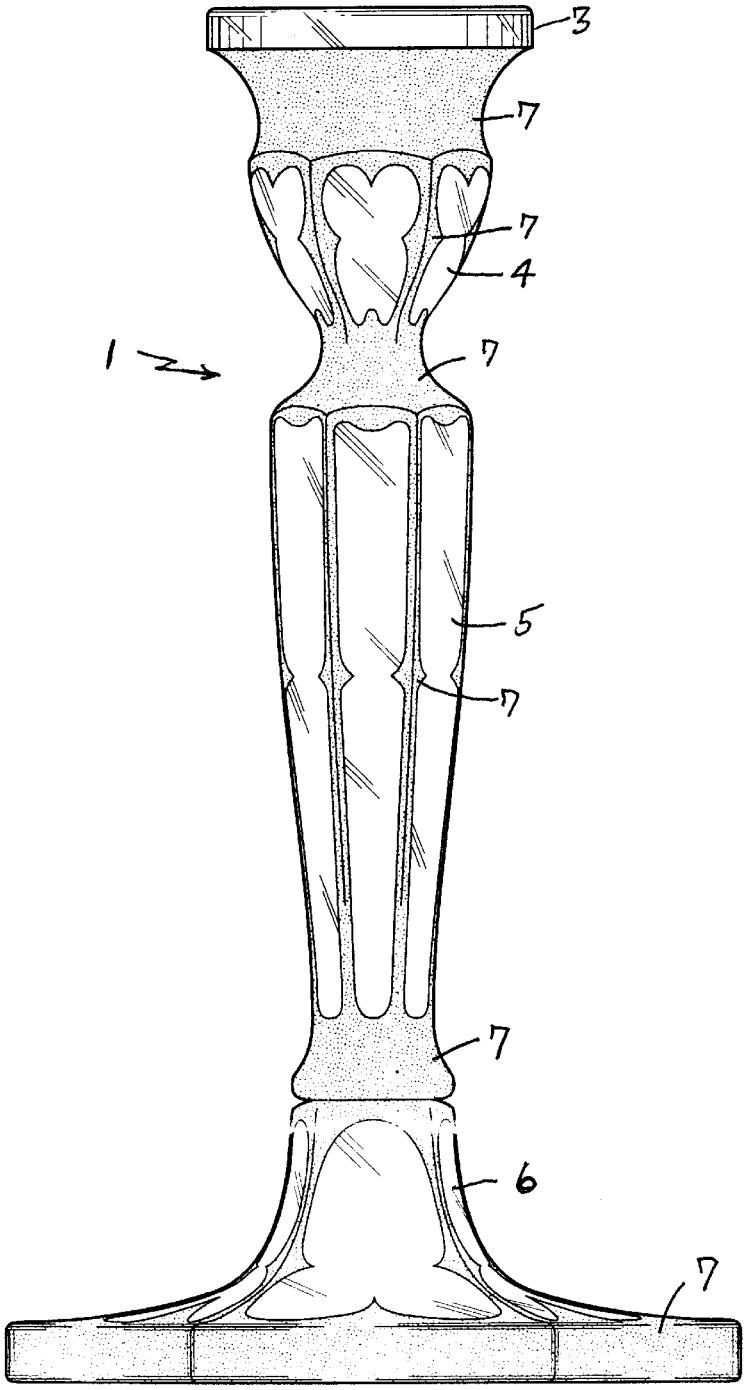
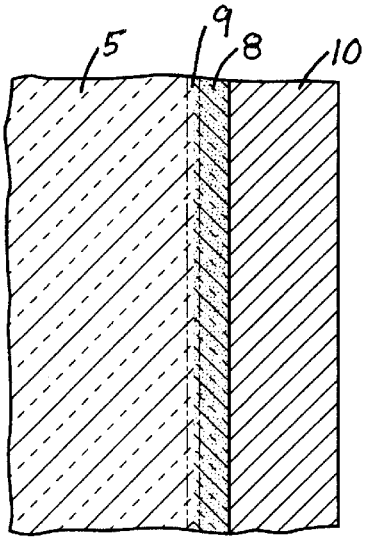
FIG. 2

METHOD FOR PRODUCING GLASS ARTICLES WITH SELECTIVELY DEPOSITED OVERLAY

This application is a continuation of application Ser. No. 08/106,134, now abandoned.

BACKGROUND OF THE INVENTION

1. Field of the Invention

The invention relates to methods for producing aesthetic decorative metal patterns on glass, plastic or other electrically non-conductive materials and articles with such patterns produced by the methods of the invention.

2. Description of Related Art

Decorative overlays of silver and other metals have been applied to glass and other electrically non-conductive surfaces in the past, but these have not been entirely satisfactory because of the relatively poor adhesion of the metal plating to the glass or other non-conductive material such as plastic. Generally speaking, such metal patterns have been applied by hand, e.g. with brushes, by silk screening, or by metal leaf. The metal is held on the non-conductive surface by an adhesive, and when the surface of the metal is rough, such as with brush application, the metal cannot be adequately polished without damaging the metal pattern.

The metal pattern has also been applied by electroplating, and in such method, conductive areas in the shape of the desired pattern are formed on the base, non-conductive material or substrate. Such areas must withstand the inherent stresses of the electric current and the plating solutions, e.g. acidic or cyanic solutions, and maintain a strong bond with the base material after being subjected to such solutions.

To be visually and artistically acceptable, the metal pattern must have sharp boundaries and should cover at least 50% of the decorated surface when applied as a decoration to various decorative items, such as, vases, bowls, decanters, plastic pens, picture frames, paper weights, coasters, etc.

It is known in the art to apply a rough, porous metal-glass or metal-ceramic frit with an abrasive to a non-conductive base material or substrate in a pattern and to fuse the mixture to the substrate for the purpose of providing heating elements on glass. See U.S. Pat. No. 3,703,445. As described in the patent, surface metal is applied to the so applied and fused frit pattern by electroless deposit, and the frit pattern, by itself, is rough and is not sufficiently conductive for electroplating. Therefore, the frit pattern must be subjected to electroless deposit before electroplating. Furthermore, the patent teaches that the use of masking is unsatisfactory.

SUMMARY OF THE INVENTION

The method of the invention provides an aesthetic decorative metal pattern on a non-conductive substrate, such as glass or plastic, by first producing an electrically conductive layer for electroplating by conventional electroplating methods in the shape of the desired pattern on an electrically non-conductive substrate. The pattern normally has a surface area at least equal to 50% of the surface area of the substrate, and such layer comprises a material which fuses with the substrate upon heating to the fusion temperature of such material and forms an intermolecular bond with the substrate. For example, if the substrate is glass, the material is a glass frit which forms such bond with the substrate. If the substrate is a plastic, the material is a plastic METAL MIXTURE which so bonds to the PCT Aug. 11, 1993 substrate.

The layer also comprises finely divided metal, e.g. silver, copper, etc., of high conductivity in an amount, e.g. at least 50% by volume of the material which bonds to the substrate, which will provide the layer with an electrical conductivity sufficient for electroplating by conventional methods.

After the first layer is bonded to the substrate, a second layer of finish metal, i.e. the metal of the pattern to be observed by the eye, e.g. silver or gold, is applied to the first layer by electroplating. If desired,, the first layer can be coated with a layer of a highly conductive metal, e.g. silver, by electroplating prior to the electroplating of the finish metal.

The finished metal pattern can be intricate and has sharply defined edges. The metal pattern has a smooth surface which, if necessary, can be polished. The method provides a strong bond of the pattern with the substrate which not only permits polishing but also withstands the stresses of the electroplating conditions.

In accordance with the preferred method of the invention, a masking resist is first applied to those areas of a glass surface which are not to be plated. The resist consists of a material which will adhere to the glass during the subsequent step of applying a frit solution, as described hereinafter, but which will detach from the substrate during fusing of the frit with the substrate by heating, such as by oxidation of the mask material which turns to ash. The resist can, for example, be paper or a thermoplastic, such as a vinyl, with adhesive on the face thereof which engages the glass article or be a rubbery plastic between two layers of paper, the surface which is to engage the glass article bearing an adhesive to hold the resist in place by the adhesive and which is covered by a release sheet, the release sheet being removed before the application of the resist.

Of course, the resist covers the area of the article which is not to be plated with the metal. The resist can be die cut or otherwise formed, and it is sufficiently formable to be applied to non-linear or non-planar surfaces.

After the resist is applied, a frit solution is applied to the resist and to the spaces where the pattern is to appear. The frit solution comprises a metal in finely ground form and in an amount sufficient to make the pattern continuously conductive after fusing, a finely ground glass which will fuse with the substrate, such as a borosilicate glass, and a carrier, such as pine oil. Preferred solutions, for silver plating comprise a frit-containing solution which can be sprayed, or otherwise applied, and consist of, by volume, about 4.5% borosilicate glass, 70% of silver and remainder pine oil or 8% borosolicate glass, 68% silver and remainder pine oil. The silver and borosilicate are in particulate form and have a particle size in the range from 300–400 mesh. The solutions can be diluted by adding up to 50% of a mixture of turpentine and mineral spirits as may be required for application.

The article with the resist and frit thereon are then subjected to heating, such as in a furnace at a temperature which will cause the glass of the frit to melt and fuse with the glass of the substrate without causing flow or slumping of the substrate glass. Such temperature can, for example, be in the range of from about 1000° F. to about 1100° F. and preferably, 1060° F. During the heating, the resist burns away and the frit solvent is evaporated leaving a continuously conductive pattern molecularly linked and strongly bonded to the substrate and with sharply defined edges.

After cleaning in a conventional manner in preparation for plating, the article is placed in a plating tank containing the electrolyte and an electrode which will provide the desired pattern surface metal, e.g. silver and is electroplated in a conventional manner.

With substrates which cannot withstand the fusing temperature of glass, such as plastics, e.g. a polycarbonate, a known type of metal loaded plastic compound without frit, such as the metal-loaded plastic paste which has been sold by Enthone-OMI Incorporated, West Haven, Connecticut, under the trademark ENTHONE, which becomes bonded to certain plastics and becomes electrically conductive when cured by heating, can be used in place of the frit-containing solution described hereinbefore, the temperature of heating being much lower, e.g. in the range of about 230°–250° F. The metal-loaded paste is applied in a continuous pattern to the plastic article and cured by heating which causes the paste to harden and chemically and intermolecularly bond to the article. The hardened pattern is then subjected to a vigorous, conventional cleaning/activating treatment, and the article is briefly immersed in a conventional silver strike plating solution. Thereafter, the pattern is electroplated in a conventional manner to build up a layer of the desired metal on the pattern. Such layer can, for example, have a thickness of about 0.003 of an inch.

When the pattern is to be applied to a flat or slightly domed surface of a non-conductive article, it may be preferable to apply the material of the first layer which is to be heated and then plated to such surface by silk screening or pad printing. Such application of the material is faster and more cost-effective for the decoration of articles such as picture frames and paper weights.

BRIEF DESCRIPTION OF THE DRAWING

FIG. 1 is an elevation view of a candle stick holder with a decorative metal pattern applied thereto by the method of the invention; and FIG. 2 is an enlarged, fragmentary, cross-sectional view of a portion of the metal pattern on the holder of FIG. 1.

DESCRIPTION OF PREFERRED EMBODIMENTS

The invention is particularly useful for decorating a three-dimensional surface and will be described in connection with the preferred embodiment in which a decorative metal layer is applied to a glass candle stick holder of the type having a flared, multi-angular base, or pedestal, from which a tapered, six sided stem extends upwardly to a candle receiver which is circular in cross-section. Peripheral grooves are between the base and the stem and between the stem and the candle receiver. It will be apparent that decoration must conform to many different surfaces which intersect at various angles. The methods of the invention permits the application of an aesthetic metal pattern to such a candle stick holder.

The glass candle stick holder 1 shown in FIG. 1 has surface areas 3–6 of bare glass with a decorative pattern of shiny metal areas 7 thereon produced in accordance with the invention.

FIG. 2 is an enlarged, fragmentary cross-section of a typical layer of metal on the cande stick of FIG. 1. Thus, the glass 5 has a layer of metal loaded glass frit 8 bonded thereto by an intermolecular bond or fusion zone 9. A metal layer 10, e.g. a layer of silver, is formed on the layer 8 by electroplating and may, for example, have a thickness on the order of 0.003 inches. While it is difficult to define the zone 9, it is a bond formed by fusion between a component of the layer 8 which is similar to the material of the glass substrate 5 and which will form a bond with the substrate 5 when heated. Such bond is to be distinguished from a bond which is produced by an adhesive such as is the case when the layer 10 is applied to the substrate by brush application or silk screening. Therefore, the bond is much stronger and can withstand electroplating conditions without damage and the layer 10 can withstand polishing without damage to the pattern. The layer 8 comprises, by volume, at least about 50% of a highly conductive metal, e.g. silver, so that it can be readily electroplated without treatment to improve its electrical conductivity. Of course, with electroplating, the layer 10 of the finish or visible metal is strongly bonded to the layer 8.

While the bond zone 9 can be produced on the glass substrate 5 by using glass frit as a component of the layer 8 and heating the substrate 5 and the layer 8 to the fusing temperatures thereof, the bond zone 9 can also be produced on a plastic substrate by using as a component of the layer 8 a plastic which will form a bond with the plastic substrate with heating which is intermolecular, e.g. like the bond between layer 8 and the substrate 5 previously described.

It will be observed that pattern formed by the layer 8 is electrically continuous so that when the layer 8 is to be electroplated, it is not necessary to make more than one electrical connection to the layer 8 even though more than one electrical connection to the layer 8 could be made.

In one method of the invention, the bare glass candle stick holder, which has been cleaned by conventional methods to remove grease, dust, etc., has a resist of adhesive backed paper, which has been cut in the shape of the areas which are not to receive the metal plating, applied to the bare glass. The paper is relatively thin, e.g. 0.010 in. or less, and the paper and the adhesive have charring temperatures below 1000° C. One suitable adhesive is a commercially available glue used for photomasks comprising GS-260, N-Butyl Acetate, propylene glycol monomethyl ether acetate and several conventional solvents. The type of paper used in masking tape has been found to be satisfactory.

Alternatively, the resist can comprise two layers of paper having a layer of elastic and flexible plastic therebetween, the layer of plastic adhering to the layers of paper and the layer of paper which is to face the bare glass having a layer of adhesive thereon which will cause the resist to adhere to the glass. The materials of the resist will char or burn off at temperatures below 1000° C.

As a further alternative, the resist can be a flexible plastic, such as vinyl plastic which has an adhesive on the face of the resist which engages the bare glass and which melts or chars at the temperature of heating in the furnace.

After the resist is applied, a frit solution comprising, by volume, about 70% of silver particles having a 300–400 mesh particle size, about 4.5% of borosilicate glass particles having a 300–400 mesh particle size and the remainder pine oil is prepared and is "cut" 50% with equal amounts of turpentine and mineral spirits. The resulting "cut" solution is sprayed on the holder over both the resist and the areas not covered by the resist.

The holder is then placed in a furnace and heated to about 1060° F. for a time sufficient to cause the borosilicate glass to fuse with the glass of the holder without causing the glass of the holder to fluidize or slump. The solvents, pine oil, turpentine and mineral spirits, evaporate and the paper and adhesive char. The desired pattern, conforming to the areas not covered by the resist and having a relatively high electrical conductivity suitable for electroplating, remains on the holder. The pattern has a strong bond with the glass of the holder so that it is not damaged by the subsequent electroplating solutions and conditions and has sharply defined edges.

Preferably, the pattern is electrically continuous so that only one electrical connection to the pattern need be made. In order that the pattern will have the desired electrical conductivity, the metal content of the layer 8 should be at least 50% by volume, but in order to provide the desired bonding should not exceed about 95%. While the metal used in the foregoing example was silver, other highly conductive metals, such as copper or gold can be used in place of silver.

After the pattern has been produced by heating and fusing, as aforesaid, the candle stick holder is cleaned in the manner conventional for cleaning an article in preparation for electroplating. The holder is then immersed in an electrolyte conventional for the purpose, and the pattern is electrically connected as one electrode. The other electrode is made of a metal which is to form the surface metal on the pattern. Such other metal can be any of several metals, e.g. silver, gold, copper, nickel, etc. In the example, the other electrode was silver and a layer of silver, e.g. a layer of a thickness of 0.003 inches, was plated on the pattern obtained after heating.

After removal of the holder from the electroplating bath, it was cleaned in the usual manner, and mild polishing was performed. The pattern with the plating metal thereon had a smooth and polished appearance with sharply defined edges and was not altered by the electroplating conditions or the polishing.

It has been observed that the pattern after heating and before electroplating has a relatively smooth surface so that when the plating metal is applied, little polishing is required. Such smooth surface is attributed to the metal content and the fineness of the particles of the frit. The particle size should not exceed the size of particles which pass through a 500 mesh and preferably, the smaller size should be particles which do not pass through 100 mesh.

When the article is made of a plastic, such as a polycarbonate, a glass frit solution, of the type described hereinbefore, cannot be used because the melting point of the glass frit is above the melting, softening or charring point of most plastics, and the glass frit solution can be replaced by a metal-loaded plastic compound of the type described hereinbefore which has a good conductivity after heat treatment. Such metal-loaded plastic compound contains a plastic mixture which hardens when heated to about 230–250° F., copper in the form of dust and diethylene glycol monobutyl ether acetate. Preferably, the plastic of the compound is selected, e.g. is the same plastic as the plastic of the article, so as to provide an inter-molecular bond between the pattern and the article. The material of the resist is one which releases from the plastic when the article is heated to the curing temperature of the plastic compound. Otherwise, the process for producing the final metal plated pattern is as described in connection with a glass substrate and a glass frit.

In the methods of the invention previously described, a resist is applied to the non-conductive article and then, the material which is to form the pattern base is applied and processed to provide a decorative metal pattern. As an alternative, the resist can be omitted when the article is made of a plastic or other material which can be modified by heating at the temperature required for fusing of the glass frit with the material of the article. In such alternative method, which is especially useful for applying a pattern to flat or slightly rounded surfaces, the metal-loaded plastic compound, previously described, e.g. containing 50–80% of finely divided metal of less than about 500 mesh is applied manually, or by conventional silk screening or pad printing to the surface to be decorated in the desired pattern. The metal-loaded plastic compound of the pattern is then heated to cause it to cure or harden, and it is sufficiently conductive to permit electroplating, as described, thereafter. Preferably, the plastic of the plastic compound is the same as the plastic of the article surface so as to provide, as in the case of the glass frit, intermolecular bonding of the pattern with the article surface, but as is known in the art, intermolecular bonding can occur between some plastics when the plastic of the article surface and the plastic of the metal-loaded compound are different. As pointed out hereinbefore, such bonding is important when the article with the pattern thereon are subjected to the stresses of the solutions, etc. used for electroplating.

Although preferred embodiments of the present invention have been described and illustrated, it will be apparent to those skilled in the art that various modifications may be made without departing from the principles of the invention.

What is claimed is:

1. A method of applying a decorative overlay pattern onto a selected surface area of a nonconductive substrate, comprising the steps of:

(A) applying a masking resist to the surface area wherein the resist defines a negative of the pattern by leaving bare substrate within the pattern;

(B) applying a frit solution comprising a heat fusible material, metal particles and a carrier onto the resist and the bare substrate, the resist remaining adhered to the substrate during application of the solution, the solution forming a conductive layer upon heating at a preselected temperature;

(C) heating the substrate, resist and solution at the preselected temperature to form the conductive layer and to form, within the pattern, a molecular bond between the substrate and the conductive layer, the conductive layer being continuously conductive throughout the pattern, the resist detaching from the substrate during the step of heating; and (D) electroplating a first finish metal onto the continuously conductive layer bonded with the substrate, wherein the first finish metal extends continuously throughout the pattern.

2. A method according to claim 1, wherein the step of electroplating comprises connecting a single electrical connection to the conductive layer.

3. A method according to claim 1, wherein the resist detaches through oxidation.

4. A method according to claim 1, wherein the resist turns to ash for subsequent washing from the substrate.

5. A method according to claim 1, wherein the resist comprises thermoplastic.

6. A method according to claim 1, wherein the step of applying a masking resist comprises utilizing an adhesive.

7. A method according to claim 1, wherein the step of applying a masking resist comprises applying the adhesive by a release sheet.

8. A method according to claim 1, wherein the substrate is non-planar.

9. A method according to claim 1, comprising the further step of die cutting the resist onto the substrate.

10. A method according to claim 1, further comprising applying a frit solution comprising ground metal, ground glass, and a carrier, such that the layer is conductive after the step of heating.

11. A method according to claim 10, further comprising utilizing borosilicate glass as the ground glass.

12. A method according to claim 10, further comprising utilizing pine oil as the carrier.

13. A method according to claim 1, wherein the step of applying the frit solution comprises spraying the solution.

14. A method according to claim 1, wherein the step of applying the frit solution comprises applying a frit solution comprising about 4.5% by volume borosilicate glass, 70% by volume silver, and remainder pine oil onto the substrate.

15. A method according to claim 1, wherein the step of applying the frit solution comprises applying solution comprising about 8% by volume borosilicate glass, 68% by volume silver, and remainder pine oil onto the substrate.

16. A method according to claim 1, wherein the step of applying the frit solution comprises utilizing a solution comprising silver and borosilicate particles.

17. A method according to claim 16, comprising utilizing silver particles in the range from 300 to 400 mesh.

18. A method according to claim 1, comprising the further step of diluting the frit solution by adding up to 50% by weight of a mixture of turpentine and mineral spirits.

19. A method according to claim 1, wherein the step of electroplating a first finish metal comprises electroplating a first finish metal with a thickness of about 0.003 inch onto the conductive layer.

20. A method according to claim 1, comprising the further step of polishing the first finish metal.

21. A method according to claim 1, wherein the step of electroplating a first finish metal comprises utilizing a first finish metal comprising at least about 50% by volume of silver.

22. A method according to claim 21, wherein the step of electroplating a first finish metal comprises utilizing a finish metal comprising less than 95% by volume of silver.

23. A method according to claim 1, wherein the step of heating comprises heating to at least about 1000 degrees F.

24. A method according to claim 1, wherein the step of heating comprises heating to 1060 degrees F.

25. A method according to claim 1, further comprising electroplating a second finish metal onto the first finish layer, the second finish metal being selected from the group consisting of silver, gold, copper and nickel.

26. A method according to claim 1, wherein the step of applying the resist comprises applying the resist to define the pattern over at least 50% of the surface area.

27. A method according to claim 1, wherein the step of applying the frit solution comprises applying the solution through silk-screening.

28. A method according to claim 1, wherein the substrate comprises glass.

* * * * *